United States Patent [19]

Ehrhardt et al.

[11] 4,132,993

[45] Jan. 2, 1979

[54] ANTENNA ELEMENT

[75] Inventors: John R. Ehrhardt, Carpinteria; George J. Monser, Goleta, both of Calif.

[73] Assignee: Raytheon Company, Lexington, Mass.

[21] Appl. No.: 633,533

[22] Filed: Nov. 19, 1975

[51] Int. Cl.[2] ..... H01Q 1/28

[52] U.S. Cl. ..... 343/705; 343/845; 343/848

[58] Field of Search ..... 343/830, 829, 848, 859, 343/705, 845

[56] References Cited

U.S. PATENT DOCUMENTS

| | | | |
|---|---|---|---|
| 3,013,226 | 12/1961 | Du Hamel et al. | 343/859 |
| 3,087,159 | 4/1963 | Gozinsky | 343/848 |

*Primary Examiner*—Maynard R. Wilbur
*Assistant Examiner*—Richard E. Berger
*Attorney, Agent, or Firm*—Richard M. Sharkansky; Joseph D. Pannone

[57] ABSTRACT

An antenna element for use in the nose section of a small missile is disclosed. The antenna element includes a ground plane and a pair of end fed radiating elements, the free ends thereof being fastened to ground plane. With such arrangement the antenna element fits compactly within the nose section and the ground plane provides a heat sink and structural support for the radiating elements.

3 Claims, 2 Drawing Figures

ANTENNA ELEMENT

BACKGROUND OF THE INVENTION

This invention relates generally to antenna elements and more particularly to antenna elements adapted for use in the nose section of relatively small missiles.

As is known in the art, it is sometimes desirable to use small missiles for transmitting radio frequency beacons and/or for detecting radio frequency signals. In such a missile it is necessary that the antenna element used therein occupy a minimum space, have sufficient structural integrity to withstand missile vibrations, particularly during launch, and handle sufficent levels of power, say in the order of 2–3 kilowatts of average power in one particular application.

SUMMARY OF THE INVENTION

In accordance with this invention a radiating element for use in the front section of a missile comprises a ground plane; a pair of radiating elements; and a feed line comprising a pair of conductors, such conductors being coupled to one end of a different one of the radiating elements, the other ends of such radiating elements being connected to the ground plane. The ground plane provides a heat sink for power dissipated by the radiating elements and also provides for structural support of the radiating elements. The geometry of the radiating elements and the configuration used to effectuate the connection of such radiating elements to the pair of conductors provides for a device having a VSWR under 2 to 1 over 30 percent bandwidth.

BRIEF DESCRIPTION OF THE DRAWINGS

For a more complete understanding of this invention reference is now made to the following description of a preferred embodiment of this invention as illustrated in the accompanying drawings wherein.

DESCRIPTION OF THE PREFERRED EMBODIMENT

Figures 1, 2:
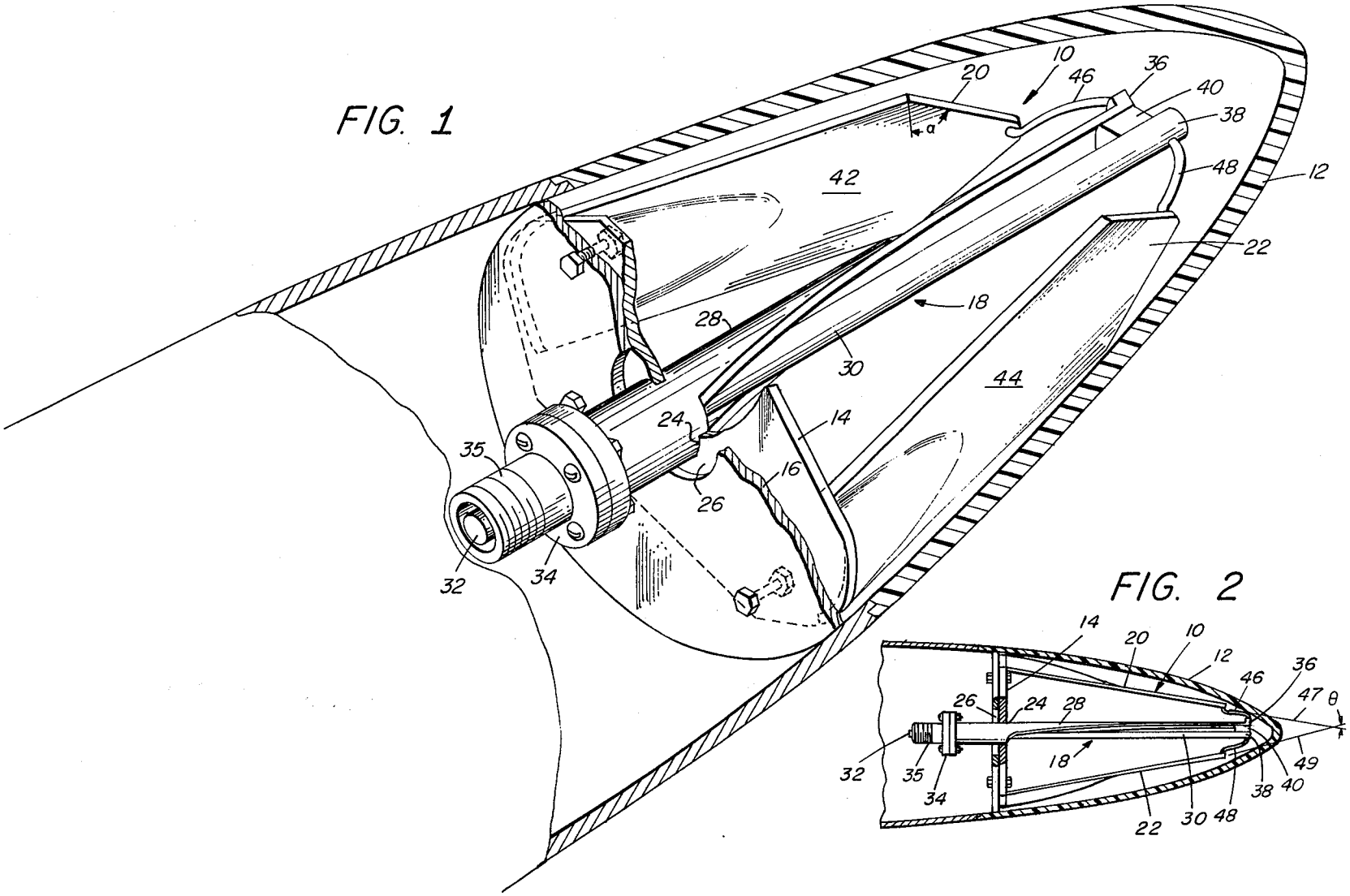
FIG. 1 is a sketch illustrating an antenna element according to the invention mounted into the nose section of a missile.
FIG. 2 is a cross-sectional view of the antenna element and missile nose section of FIG. 1.

Referring now to FIGS. 1 and 2, an antenna element 10 is shown disposed within the radome covered nose section of a missile 12. Antenna element 10 here is adapted to operate in the VHF range of 720–880 MHz while handling two to three kilowatts of average power. Such antenna element 10 includes a metal ground plane 14, here bolted to a bulkhead 16 of missile 12, a balun feed line 18, and a pair of radiating elements 20, 22 fed by such feed line 18 at one of the ends thereof and secured (here welded) to the ground plane 14 at the other one of the ends thereof.

Ground plane 14 here is elliptically-shaped, having a major axis length of 4.6 inches and a minor axis length of 3.4 inches. Apertures 24, 26 are formed in the centers, along the longitudinal axis of the missile, of such ground plane 14 and bulkhead 16. The diameter of the aperture 24 formed in the ground plane 14 is here slightly larger than 0.75 inch and the diameter of aperture 26 is here in the order of 1.0 inches.

Feed line 18 includes two conductors 28, 30. Conductor 30 is connected to the center conductor 32 of a coaxial connector 34 and conductor 28 is connected to the outer portion 35 of such coaxial connector 34. In the vicinity of the aperture 24 conductor 28 encircles conductor 30, as shown, and the encircling portion of such conductor 28, here having an outer diameter of 0.75 inches, is welded to the ground plane 14 at the point where such conductor 28 passes through aperture 24. The profile of conductor 28 exponentially tapers (as shown in FIG. 2) to form a feed terminal 36. The forward end of conductor 30 forms a feed terminal 38. Such feed terminals 36, 38 are disposed in a common plane orthogonal to the missile's longitudinal axis. The distance from the ground plane to the feed terminals 36, 38 along the longitudinal axis, is here in the order of 5 inches. An insulating spacer 40 is fastened, here by any suitable epoxy, (not shown) between the feed terminals 36, 38 to insulate such feed terminals and to physically secure the ends of the antenna conductors 28, 30. Such spacer 40 also maintains a suitable separation between feed terminals 36, 38, here in the order of 0.12 inches.

Radiating elements 20, 22 have tapered planar shaped surfaces 42, 44, as shown. Such surfaces 42, 44 are disposed in intersecting planes 47, 49 (FIG. 2), respectively. Such planes 47, 49 have an included angle $\theta$, here 30°–40°. The tapered ends of such radiating elements 20, 22 are connected to feed terminals 36, 38, respectively, by arcuately shaped connecting rods 46, 48, respectively, as shown. The length of such rods 46, 48 is here in the order of 0.75 inch. Such rods here have a diameter of 0.0625 inch and are S-shaped, the curved portions thereof having radii here in the order of 0.25 inch. The S-shaped rods are so configured to provide a "continuous" transition from feed terminals 36, 38 to the radiating elements 20, 22 thereby to improve the VSWR of the antenna element 10. The width and the thickness of the radiating elements 20, 22 are 1.7 inches and 0.0625, respectively. The ends are tapered at an angle $\alpha$, here in the order of 55°, the tapered edge extending for a length in the order of 1.47 inches. It is noted that here the lower operating frequency of the antenna element 10 is 720 MHz (i.e. a wavelength $\lambda_o$ of 16.4 inches.) The length of each one of the radiating elements 20, 22 (including the length of each one of the S-shaped connecting rods 46, 48, that is the length of the radiating elements 20, 22 and connecting rods 46, 48 from the feed terminals 36, 38 to the ground plane 14) has been found to be optimum when such length is slightly larger than an odd integral multiple $\lambda_o/4$, here such length being 5.3 inches.

With such an antenna element 10 constructed as described the ground plane 14 provides a heat sink and structural integrity for such element.

Having described a preferred embodiment of the invention, it is now evident that other embodiments incorporating its concepts may be used. For example, while such antenna element has been shown in the nose section of a missile, such antenna element may also be used in other small spaces such as in a wing mounted pod of an aircraft. Further, while connecting rods 46, 48 are shown to make a "continuous" transition from the feed terminals 36, 38 to the radiating elements 20, 22, the tips of such radiating elements may be suitably rounded and connected to the feed terminals to provide such "continuous" transition.

It is felt, therefore, that this invention should not be restricted to its disclosed embodiments but rather should be limited only by the spirit and scope of the appended claims.

What is claimed is:

1. An antenna element comprising:

(a) a ground plane;

(b) a pair of end fed radiating elements, each one having a first and second end, the first end of each one of the pair of radiating elements being fastened to the ground plane and the radiating elements having planar surfaces, such surfaces being disposed in intersecting planes; and (c) a feed line having a pair of terminals, each one feeding the second end of a different one of the pair of radiating elements, such feed line including an outer conductor and an inner conductor, the outer conductor being fastened to the ground plane, and wherein the second ends of the pair of radiating elements are coupled through a continuous transistion to a different one of the pair of conductors.

2. The antenna element recited in claim 1 wherein the feed ends of the pair of radiating elements are tapered.

3. The antenna element recited in claim 2 wherein the length of the radiating elements from the feed terminal thereof to the ground plane is slightly greater than the wavelength of the lowest operating frequency of the antenna element.

* * * * *